US006351192B1

(12) United States Patent
Sheen

(10) Patent No.: US 6,351,192 B1
(45) Date of Patent: Feb. 26, 2002

(54) MINIATURIZED BALUN TRANSFORMER WITH A PLURALITY OF INTERCONNECTING BONDWIRES

(75) Inventor: Jyh-Wen Sheen, Ilane (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/602,897

(22) Filed: Jun. 23, 2000

Related U.S. Application Data

(63) Continuation-in-part of application No. 09/275,946, filed on Mar. 25, 1999, now Pat. No. 6,133,806.

(51) Int. Cl.[7] ..... H01P 5/10
(52) U.S. Cl. ..... 333/26; 333/33
(58) Field of Search ..... 333/26, 33; 343/889

(56) References Cited

U.S. PATENT DOCUMENTS

| | | | | |
|---|---|---|---|---|
| 4,460,877 A | | 7/1984 | Sterns | 333/26 |
| 4,725,792 A | | 2/1988 | Lampe, Jr. | 333/26 |
| 4,755,775 A | | 7/1988 | Marczewski et al. | 333/26 |
| 4,847,626 A | | 7/1989 | Kahler et al. | 343/700 MS |
| 4,994,755 A | | 2/1991 | Titus et al. | 330/54 |
| 5,015,972 A | | 5/1991 | Cygan et al. | 333/26 X |
| 5,025,232 A | | 6/1991 | Pavio | 333/26 |
| 5,039,891 A | | 8/1991 | Wen et al. | 333/25 X |
| 5,451,914 A | * | 9/1995 | Stengel | 333/26 X |
| 5,455,545 A | | 10/1995 | Garcia | 333/26 |
| 5,497,137 A | | 3/1996 | Fujiki | 336/200 |
| 5,574,411 A | | 11/1996 | Apel et al. | 333/25 |

* cited by examiner

*Primary Examiner*—Justin P. Bettendorf
*Assistant Examiner*—Joseph Chang
(74) *Attorney, Agent, or Firm*—Stevens, Davis, Miller & Mosher LLP

(57) ABSTRACT

A balun circuit includes a dielectric substrate having planar opposing surfaces; a groundplane conductor layer disposed on a first opposing surface; an interlayer conductor layer disposed on a second opposing surface and including first and second electrically isolated conducting strips, with a balance point gap between first ends thereof, and second ends thereof being short-circuited; an interlayer dielectric layer having substantially planar opposing surfaces, with a first opposing surface thereof being disposed over the interlayer conductor layer; and a top conductor layer disposed over a second opposing surface of the interlayer dielectric layer and including a third conducting strip overlying the first and second conducting strips, one end of the third conducting strip providing an unbalanced port terminal and another end of the third conducting strip being open-circuited. The third conducting strip includes a first and a second set of series-connected line sections each having diverse impedances which are a mirror opposite of each other relative to a center plane of the balun circuit. The first and second conducting strip have impedances which are a mirror opposite of each other relative to the center plane of the balun circuit. The impedances of the first and second conducting strips can be diverse impedances. Phase and amplitude balance at the balance point gap is achieved by the mirror opposite relationship of the impedances of the first and second set of line sections and the mirror opposite relationship of the impedances of the first and second conducting strips. The diverse impedances can be provided by stepped impedance junctions whose values are selected to provide the desired impedance matching between the balanced and unbalanced ports, wherein the larger the stepped impedance is the smaller the balun circuit may be.

8 Claims, 9 Drawing Sheets

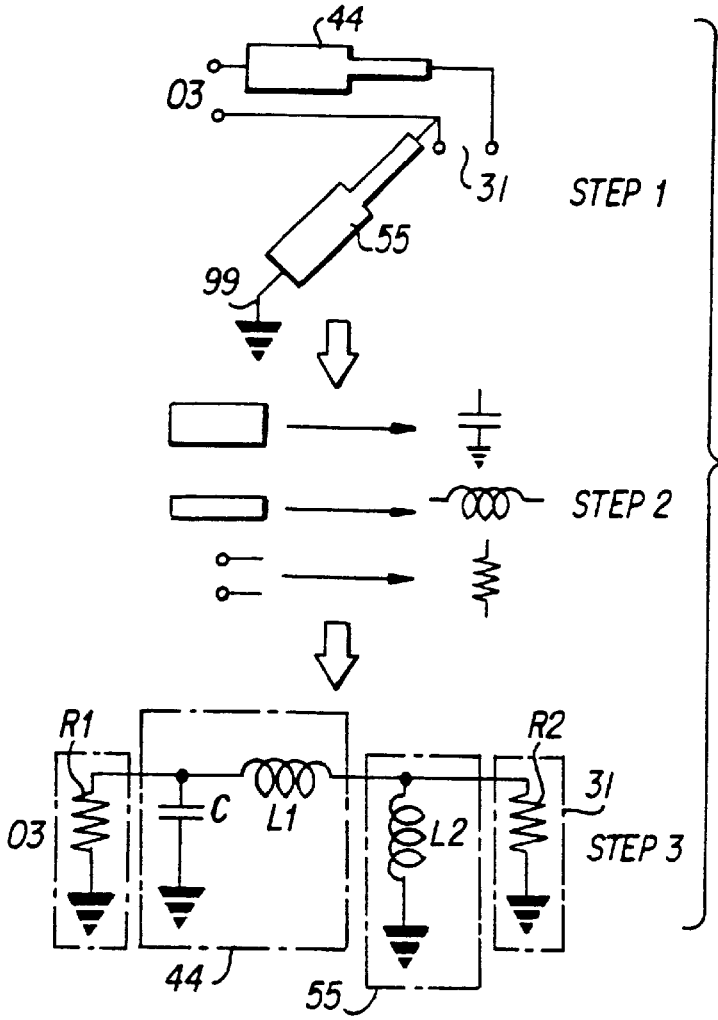
FIG. 3(c)
FIG. 16
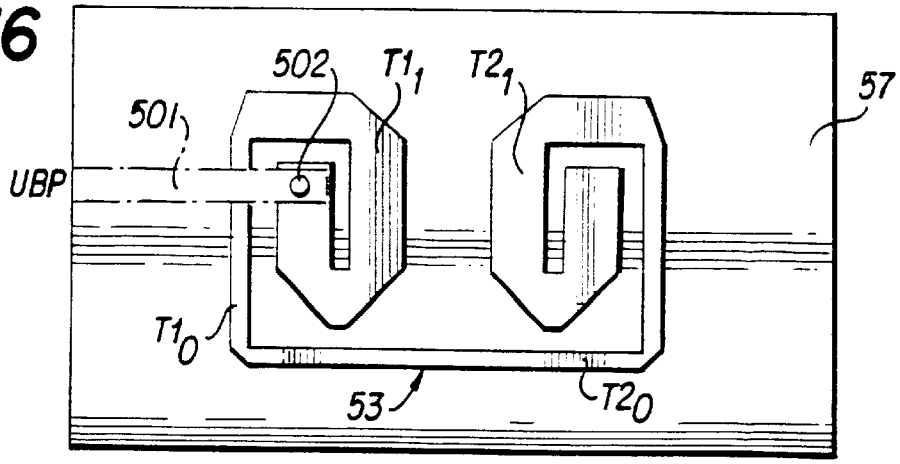

MINIATURIZED BALUN TRANSFORMER WITH A PLURALITY OF INTERCONNECTING BONDWIRES

This application is a continuation-in-part of Ser. No. 09/275,946 filed Mar. 25, 1999 now U.S. Pat. No. 6,133,806, the entire disclosure of which, except for FIGS. 13 and 14 and the discussion thereof, is incorporated by reference herein.

BACKGROUND OF THE INVENTION

1. Field of the Invention

This invention relates to balun circuits for coupling between balanced and unbalanced lines or devices in an electronic system. More particularly, this invention relates to a miniaturized multi-layer balun circuit for use in mobile communication devices such as portable telephones and cordless telephones.

2. Description of Related Art

Typically, a balun is used to couple a two-line balanced circuit, such as a cellular telephone circuit, to a single-line (unbalanced) circuit, such as an antenna circuit. The following references provide background information relating to baluns and are incorporated by reference herein in their entireties:

[1] U.S. Pat. No. 4,994,755 to Titus et al., entitled "Active Balun," Feb. 19, 1991;

[2] U.S. Pat. No. 5,039,891 to Wen et al., entitled "Planar Broadband FET Balun," Aug. 13, 1991;

[3] U.S. Pat. No. 5,574,411 to Apel et al., entitled "Lumped Parameter Balun," Nov. 12, 1996;

[4] S. A. Maas, "Microwave Mixers", Artech House, pp 244–255;

[5] U.S. Pat. No. 5,455,545 to Garcia, entitled "Compact Low-loss Microwave Balun," Oct. 3, 1995;

[6] U.S. Pat. No. 4,725,792 to Lampe, Jr., entitled "Wideband Balun Realized By Equal-Power Divider and Short Circuit Stubs," Feb. 16, 1988;

[7] U.S. Pat. No. 4,460,877 to Sterns, entitled "Broad-Band Printed-Circuit Balun Employing Coupled Strip All Pass Filter," Jul. 17, 1984;

[8] U.S. Pat. No. 5,497,137 to Fujiki, entitled "Chip Type Transformer," Mar. 5, 1994;

[9] U.S. Pat. No. 5,025,232 to Pavio, entitled "Monolithic Multilayer Planar Transmission Line," Jan. 18, 1991;

[10] U.S. Pat. No. 4,847,626 to Kahler et al., entitled "Microstrip Balun-Antenna," Jul. 11, 1989; and

[11] U.S. Pat. No. 4,755,775 to Marczewski et al., entitled "Microwave Balun for Mixers and Modulators," Jul. 5, 1988.

The term "balun" is a contraction of balanced to unbalanced. A balun is a RF balancing network or electric circuit for coupling an unbalanced line or device and a balanced line or device for the purpose of transforming from balanced to unbalanced or from unbalanced to balanced operation, with minimum transmission losses and high impedance transformation ratio. A balun is normally used between equipment and transmission lines or between transmission lines and antennas. A balun can be used with an unbalanced input and a balanced output or, in the reverse situation, a balanced source and an unbalanced load. Baluns can be used to interface an unbalanced input with a balanced transmission line by dividing the signal received at its unbalanced terminal equally to two balanced terminals and by providing the signal at one balanced terminal with a reference phase and the signal at the other balanced terminal with a phase equal to the reference phase plus or minus 180°. Baluns can be used to interface a balanced or differential input from a balanced pair of two unbalanced transmission lines providing output signals which are 180° out-of-phase (odd-mode excitation) and an unbalanced load driven by a single-ended input signal. The balun combines the signals of the balanced input and provides the combined signal at an another port.

A balanced line has two very closely spaced current paths (usually wires), each displaying an equal impedance with respect to ground. At all physical points along the line, the currents in the two paths are equal in magnitude and opposite in direction. Because the two paths are very closely spaced in relation to the wavelength of the signal they carry, their electromagnetic fields cancel each other everywhere in space except in the immediate vicinity of the line. The balanced structure is usually needed in devices such as balanced mixers, modulators, attenuators, switches and differential amplifiers, since balanced circuits can provide better circuit-to-circuit isolation, dynamic range, and noise and spurious signal cancellation. A balanced load is defined as a circuit whose behavior is unaffected by reversing the polarity of the power delivered thereto. A balanced load presents the same impedance with respect to ground, at both ends or terminals. A balanced load is required at the end of a balanced transmission line to ensure that the currents in the line will be equal and opposite.

Depending on the implementation, baluns can be divided into two groups: active and passive. Active baluns are described in references [1] and [2] and are constructed by using several transistors (so-called active devices). Although active baluns are very small, they are not generally preferred for the following reasons. First, due to the employment of active devices, noise will be introduced into the system. Also, active devices tend inherently to waste power; this makes them quite disadvantageous in radio telephone systems. Additionally, the low-cost fabrication of active baluns is limited to semiconductor manufacture. Conversely, passive baluns are quite popular. Passive baluns can be categorized into lumped-type baluns, coil-type baluns, and distributed-type baluns.

Lumped-element-type baluns are described in references [3] and [4]. Lumped-element baluns employ discrete components that are electrically connected, such as lumped element capacitors and lumped element inductors. Advantages of lumped-element-type baluns include small size and suitability for low frequency range usage. On the other hand, the performance of lumped-element-type baluns is not good in high frequency ranges (several Ghz), because the lumped elements are very lossy and difficult to control. Also, the operational bandwidth of lumped-element-type baluns is small (<10%, typically).

Coil-type baluns (trifilar transformers) are very popular in applications in the UHF band or lower frequency range. Shortcomings of the trifilar transformer include unacceptable lossiness in the frequency range higher than the UHF band, and barriers to miniaturization beyond a certain size.

There are many kinds of distributed-type baluns. The first type is the 180° hybrid device described in references [4] and [5]. They are constructed by several sections of quarter-wavelength transmission lines and a section of half-wavelength transmission line. The drawbacks of the 180° hybrid device are size, difficulty in achieving a high impedance transformation ratio, and limitation to a balanced pair of unbalanced outputs. A second type is the combination of a power divider and a 180° phase shifter as described in references [6] and [7]. Since the 180° phase shift is achieved by a half-wavelength length difference, the size is still too large. The third type is the well-known Marchand-type balun as described in references [8]–[11]. This type of balun has very wide bandwidth (multi-octave). Further, both the phase balance and the amplitude balance are excellent. Moreover, it can be applied not only in a balanced port (load) but also in a balanced pair of unbalanced transmission lines.

A Marchand-type balun is illustrated in FIG. 1, and its equivalent circuit is shown in FIG. 2. In FIG. 1, balun 10 is constructed by a substrate 12 having formed on one surface a transmission line structure defined by a top conductive strip 14 and interlevel conductive strips 16 and 17, separated by an interlevel dielectric layer 13. A ground plane electrode 18 is formed on the opposing planar surface of dielectric substrate 12. Top conductor 14 includes a relatively narrow section 14-1 and a relatively wide section 14-2. Interlevel conductor 16 underlies the top section 14-1, and interlevel conductor 17 underlies the top section 14-2. Top conductor 14 is continuous in length, while interlevel conductors 16 and 17 are separated by a central balance point gap G that centers on the transition between the 14-1 and 14-2 sections of top conductor 14. Interlevel conductors 16 and 17 are electrically isolated from one another and are connected through via-holes 15 to ground plane electrode 18. A load may be coupled across the balance point gap G via a pair of microstrip transmission line strips 16-1 and 17-1 extending from the balance point ends of respective interlevel conductor strips 16 and 17. Strips 16-1 and 17-1 thus constitute the balanced port BP. Input terminals may be connected across one of interlevel conductors 16 and 17 and the corresponding sections 14-1 and 14-2 of top conductor 14, to provide the unbalanced port UBP. The length of each of the interlevel conductor sections 16 and 17 is ¼ λ. The width of the top conductor section connected to the unbalanced port UBP controls the impedance transformation ratio. This section is equivalent to a ¼ λ impedance transformer. A drawback to this configuration is that the size is ½λ. In RF applications, this size is still too large. In reference [8], the size is reduced by a zigzag and spiral arrangement. Under such arrangement, the modified Marchand-type balun can be chip-sized. However, the discontinuities of the spiral and zigzag arrangement will introduce some losses.

SUMMARY OF THE INVENTION

One object of the present invention to reduce the size of the conventional Marchand-type balun circuit.

It is another object of the present invention to minimize the number of spiral turns for a fixed size to decrease losses resulting from discontinuities.

According to a first embodiment of the invention, there is provided a balun circuit comprising a dielectric substrate having substantially planar opposing surfaces; a ground-plane conductor layer disposed on a first one of the opposing surfaces of the dielectric substrate; an interlayer conductor layer disposed on a second one of the opposing surfaces of the dielectric substrate and comprising first and second conducting strips electrically isolated from each other and having a balance point gap between first and second ends thereof, wherein balanced port terminals are provided on respective sides of the balance point gap, said first and second conducting strips having second ends that are short-circuited to the groundplane conductor layer; an interlayer dielectric layer having substantially planar opposing surfaces, with a first one of the opposing surfaces of the interlayer dielectric layer being disposed over the interlayer conductor layer; and a top conductor layer disposed over a second one of the opposing surfaces of the interlayer dielectric layer and comprising a third conducting strip overlying the first and second conducting strips, one end of the third conducting strip providing an unbalanced port terminal and another end of the third conducting strip being open-circuited, wherein the third conducting strip comprises a first set of series-connected line sections having diverse impedances and a second set of series-connected line sections having diverse impedances which are a mirror opposite of the diverse impedances of the first set of line sections relative to a center plane of the balun circuit passing through the balance point gap and being orthogonal to the opposing surfaces of the dielectric substrate, and the first conducting strip has an impedance which is a mirror opposite of an impedance of the second conducting strip relative to the center plane of the balun circuit, whereby phase and amplitude balance at the balance point gap is achieved by the mirror opposite relationship of the impedances of the first and second set of line sections and the mirror opposite relationship of the impedances of the first and second conducting strips.

Now there will be described various detailed alternative configurations of the first embodiment.

In one configuration of the balun circuit according to the first embodiment, the first set of line sections having diverse impedances comprises a first segment and a second segment connected to one another and having different widths to provide a stepped impedance junction, the first segment being closer to the center plane of the balun circuit and being narrower than the second segment, and the second set of line sections having diverse impedances comprises a third segment and a fourth segment connected to one another and having different widths to provide a stepped impedance junction, the third segment being closer to the center plane and being narrower than the fourth segment.

In another configuration of the balun circuit according to the first embodiment, the first set of line sections having diverse impedances comprises a first segment and a second segment connected to one another and having different widths to provide a stepped impedance junction, the first segment being closer to the center plane of the balun circuit and being wider than the second segment, and the second set of line sections having diverse impedances comprises a third segment and a fourth segment connected to one another and having different widths to provide a stepped impedance junction, the third segment being closer to the center plane and being wider than the fourth segment.

In another configuration of the balun circuit according to the first embodiment, the first conducting strip comprises a third set of series-connected line sections having diverse impedances, the second conducting strip comprises a fourth set of series-connected line sections having diverse impedances which are a mirror opposite of the diverse impedances of the third set of series-connected line sections relative to the center plane of the balun circuit, and the third set of line sections having diverse impedances comprises a fifth segment and a sixth segment connected to one another and having different widths to provide a stepped impedance junction, the fifth segment being closer to the center plane of the balun circuit and being narrower than the sixth segment, and the fourth set of line sections having diverse impedances comprises a seventh segment and an eighth segment connected to one another and having different widths to provide a stepped impedance junction, the seventh segment being closer to the center plane of the balun circuit and being narrower than the eighth segment, whereby impedance characteristics of the segments providing the stepped impedance junctions are set to achieve impedance matching of the unbalanced port and the balanced port.

In yet another configuration of the balun circuit according to the first embodiment said first conducting strip comprises a third set of series-connected line sections having diverse impedances, the second conducting strip comprises a fourth set of series-connected line sections having diverse impedances which are a mirror opposite of the diverse impedances of the third set of series-connected line sections relative to the center plane of the balun circuit, and the third set of line sections having diverse impedances comprises a fifth segment and a sixth segment connected to one another and having different widths to provide a stepped impedance junction, the fifth segment being closer to the center plane and being wider than the sixth segment, and the fourth set of line sections having diverse impedances comprises a seventh segment and an eighth segment connected to one another and having different widths to provide a stepped impedance junction, the seventh segment being closer to the center plane of the balun circuit and being wider than the eighth segment, whereby impedance characteristics of the segments providing the stepped impedance junctions are set to achieve impedance matching of the unbalanced port and the balanced port.

In another configuration of the balun circuit according to the first embodiment, the top conductor layer further comprises a fourth conducting strip interconnecting the first set of line sections and the second set of line sections, the fourth conducting strip minimizing degradation of the amplitude balance at the balance point gap.

In another configuration of the balun circuit according to the first embodiment, there is additionally provided a chip capacitor having one end connected to the third conducting strip at the center plane of the balun circuit and another end connected to the groundplane conductor layer.

In the balun circuit according to the first embodiment, the first, second and third conducting strips can have one of a straight configuration, a spiral configuration and a zigzag configuration.

According to a second embodiment of the present invention, there is provided a balun circuit comprising a first dielectric substrate having substantially planar opposing surfaces; a first groundplane conductor layer disposed on a first one of the opposing surfaces of the first dielectric substrate; an interlayer conductor layer disposed on a second one of the opposing surfaces of the first dielectric substrate and comprising first and second conducting strips electrically isolated from each other and having a balance point gap between first and second ends thereof, wherein balanced port terminals are provided on respective sides of the balance point gap, said first and second conducting strips having second ends that are short-circuited to the groundplane conductor layer; an interlayer dielectric layer having substantially planar opposing surfaces, with a first one of the opposing surfaces of the interlayer dielectric layer being disposed over the interlayer conductor layer; a top conductor layer disposed over a second one of the opposing surfaces of the interlayer dielectric layer and comprising a third conducting strip overlying the first and second conducting strips, one end of the third conducting strip providing an unbalanced port terminal and another end of the third conducting strip being open-circuited; a second dielectric layer having substantially planar opposing surfaces, with a first one of the opposing surfaces of the second dielectric layer being disposed over the top conductor layer; and a second groundplane conductor layer disposed on a second one of the opposing surfaces of the second dielectric layer, wherein the third conducting strip comprises a first set of series-connected line sections having diverse impedances and a second set of series-connected line sections having diverse impedances which are a mirror opposite of the diverse impedances of the first set of line sections relative to a center plane of the balun circuit passing through the balance point gap and being orthogonal to the opposing surfaces of the dielectric substrate, and the first conducting strip has an impedance which is a mirror opposite of an impedance of the second conducting strip relative to the center plane, whereby phase and amplitude balance at the balance point gap is achieved by the mirror opposite relationship of said impedances of said first and second set of line sections and said mirror opposite relationship of the impedances of the first and second conducting strips. In the second embodiment, there exist various detailed alternative configurations like those discussed above with regard to the first embodiment.

According to a third embodiment of the present invention, there is provided a balun circuit comprising a dielectric substrate having substantially planar opposing surfaces; a groundplane conductor layer disposed on a first one of the opposing surfaces of the dielectric substrate; a first conductor layer disposed on a second one of the opposing surfaces of the dielectric substrate and comprising first and second conducting strips electrically isolated from each other and having a balance point gap between first ends thereof, wherein balanced port terminals are provided on respective sides of the balance point gap, the first and second conducting strips having second ends that are short-circuited to the groundplane conductor layer; a second conductor layer disposed on the second one of the opposing surfaces and comprising a third conducting strip spaced apart from and substantially parallel to the first and second conducting strips, one end of the third conducting strip providing an unbalanced port terminal and another end of the third conducting strip being open-circuited; a third conductor layer disposed on the second one of the opposing surfaces and comprising a fourth conducting strip spaced apart from and substantially parallel to the first, second and third conducting strips, the fourth conducting strip being connected to the groundplane conductor layer; and a plurality of bond wires interconnecting the third conductor layer with the first and second conducting strips, wherein the third conducting strip comprises a first set of series-connected line sections having diverse impedances and a second set of series-connected line sections having diverse impedances which are a mirror opposite of the diverse impedances of the first set of line sections relative to a center plane of the balun circuit passing through the balance point gap and being orthogonal to the opposing surfaces of the dielectric substrate, and the first conducting strip has an impedance which is a mirror opposite of an impedance of the second conducting strip relative to the center plane of the balun circuit, whereby phase and amplitude balance at the balance point gap is achieved by the mirror opposite relationship of the impedances of the first and second set of line sections and the mirror opposite relationship of the impedances of the first and second conducting strips.

In the third embodiment, there exist various detailed alternative configurations like those discussed above with regard to the first embodiment.

BRIEF DESCRIPTION OF THE DRAWINGS

FIG. 3(*b*) is a more detailed equivalent circuit of the first embodiment.

FIG. 3(*c*) illustrates transformation from distributed equivalent to lumped-element equivalent.

FIGS. 5(*b*) and (*c*) show modified configurations of the FIG. 5(*a*) embodiment.

FIG. 16 is a top view of the top conductor layer of FIG. 5(*a*) in a spiral configuration.

DETAILED DESCRIPTION OF THE INVENTION

Figure 3A:
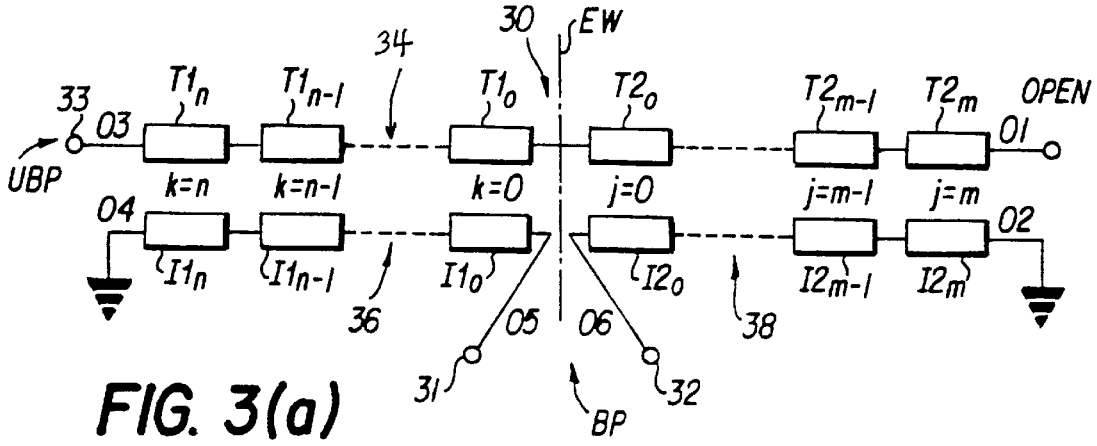
FIG. 3(*a*) is an equivalent circuit of a first embodiment of the present invention.
Figure 3B:
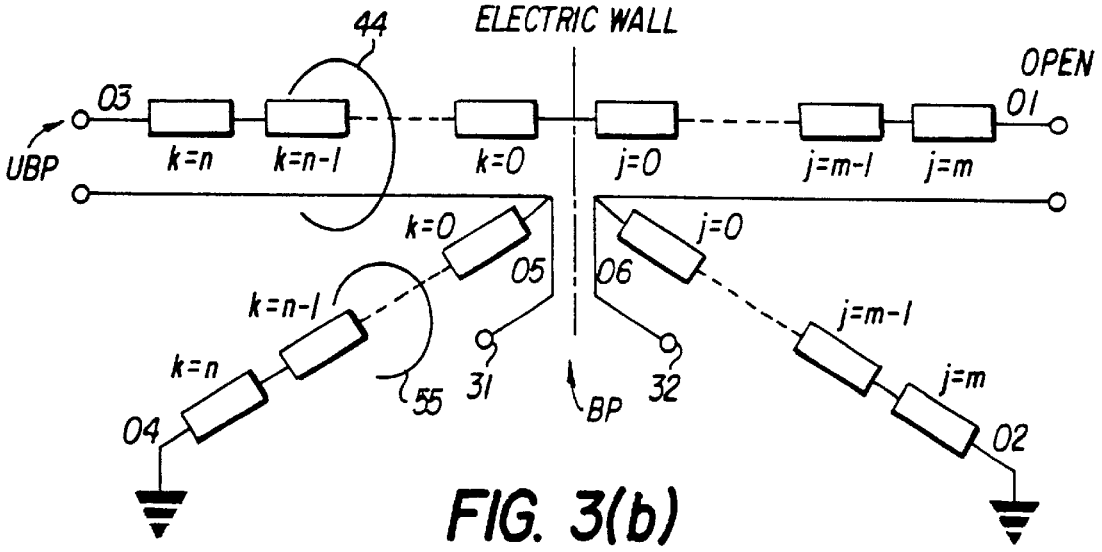

FIG. 3(*a*) is an equivalent circuit of a first embodiment of the present invention. FIG. 3(*b*) is a more detailed equivalent circuit of the first embodiment in which the coupled lines are decomposed into single lines.

Figure 1:
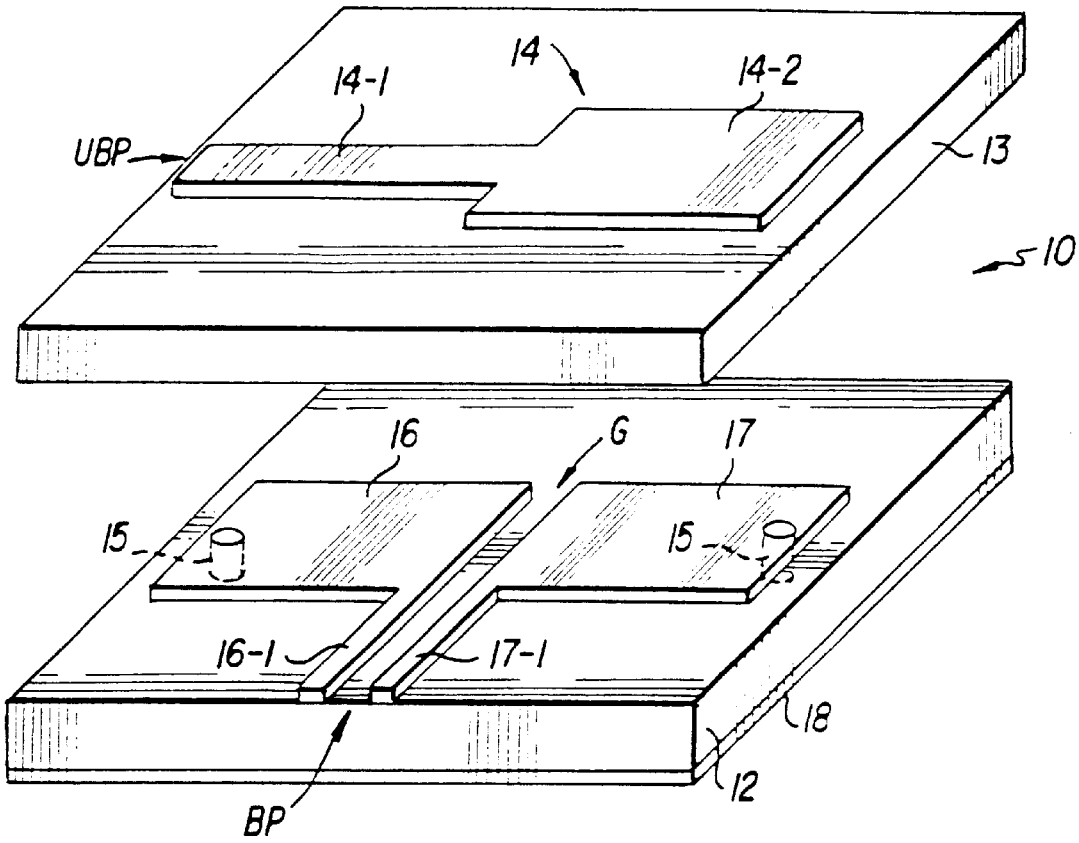
FIG. 1 (PRIOR ART)
FIG. 1 is a schematic diagram of a prior art Marchand-type balun.
Figure 2:
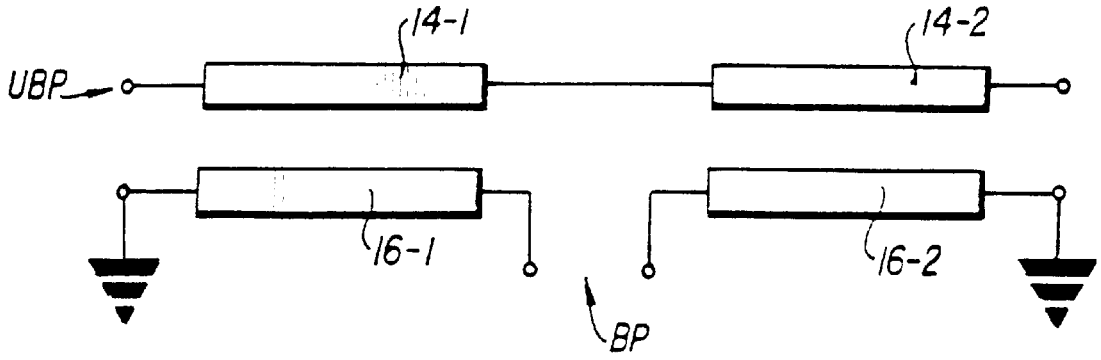
FIG. 2 (PRIOR ART)
FIG. 2 is the equivalent circuit of the FIG. 1 device.

In FIG. 3(*a*), balun 30 includes a top conductive line 34 (which corresponds generally to top conductive strip 14 of FIG. 2) and interlevel conductive lines 36 and 38 (which correspond generally to interlevel conductor strips 16 and 17 of FIG. 2). Top conductive line 34 of FIG. 3(*a*) includes n+m line sections $T1_k$, k=0, . . . , n and line sections $T2_j$, j=0, . . . , m coupled in series as shown. Interlevel conductor lines 36 and 38 together include n+m line sections $I1_k$, k=0, . . . , n, and conductor 38 includes line sections $I2_j$, j=0, . . . , m. Line sections $I1_k$, k=0, . . . , n are coupled in series and line sections $I2_j$, j=0, . . . , m are also coupled in series. A central balance point gap G at which balanced signals appear is located between $I1_0$ and $I2_0$. Line sections $T1_k$ and $T2_j$ where k=j are provided with the same physical configuration, e.g., the same line width and the same spacing between adjacent line sections. Similarly, $I1_k$ and $I2_j$, where k=j have the same physical configuration. As shown in FIG. 3(*a*), upper end 01 of top conductive line 34 is open-circuited, upper end 03 of top conductive line 34 is the unbalanced port (this could optionally be reversed, that is, end 03 could be open-circuited and end 01 could be the unbalanced port) and lower ends 02 and 04 of interlevel conductors 36 and 38 are grounded. Balanced port BP has terminals 31 and 32 at line sections $I1_0$ and $I2_0$ of interlevel conductors 36 and 38. If we set m=n and replace the unbalanced port with an open circuit, the physical configuration of the balun is symmetrical relative to the circuit center. Because upper end 01 of the coupled-line section $T2_m$,$I2_m$ is open-circuited, the center of the circuit can be treated approximately as a short circuit or an electric wall EW at which only orthogonal electric field components exits. This electric wall-symmetry plane forces ports 31 and 32 to be images of each other. Therefore, excellent phase balance and amplitude balance at the balanced port of balun 30 are achieved.

Impedance matching of the unbalanced port UBP and the balanced port BP is achieved by the stepped impedance matching of the plural coupled line sections of the top conductor 34 and the interlevel conductors 36 and 38. The principles underlying the impedance matching are explained as follows.

First, assume the circuit center is placed approximately at an electric wall represented by dashed line EW in FIGS. 3(*a*) and 3(*b*). This approximation is adequate under the symmetric arrangement of the coupled-transmission lines of FIGS. 3(*a*) and 3(*b*). It also leads to a clearer understanding of the impedance matching. Given the assumption that the circuit has an electric-wall symmetry property, the impedance matching principles can be deduced from an analysis of the left part of the circuit shown in FIG. 3(*b*). Before discussing these impedance matching principles, it should be noted that the decoupling from the coupled-line model in FIG. 3(*a*) to the single-line model in FIG. 3(*b*) is valid only for the cases that the effect between the ground plane (e.g., groundplane conductor plane 58 of FIG. 5(*a*)) and the transmission line between 03 and 01 in FIG. 3(*a*) can be neglected. Such decoupling is usually proper in tight coupling cases. In such cases, the lines between 04 and 02 can be treated as the ground line of the transmission line between 03 and 01. Therefore, the straight-line sections without rectangular boxes in FIG. 3(*b*) represent the ground lines which take into consideration the effect between coupled lines. Then, the effect between the transmission line between 04 and 02 in FIG. 3(*a*) and the ground plane is represented as the transmission line sections between 04 (02) and 05 (06) in FIG. 3(*b*). It is clear that the impedance matching is dominated by the series-connected transmission lines 44 and the series-connected transmission lines 55 only contribute a reactance at port 31. That this is true may be shown by an example where m=n=2 and the impedance transformation ratio 03/31>1. The practical balun corresponding to this example is similar to that shown in FIG. 5(*a*). The equivalent circuit with the right part in FIG. 3(*b*) neglected is shown in step 1 of FIG. 3(*c*). The wider lines represent the wider lines in FIG. 5(*a*). Then, for a more clear understanding, an approximate lumped-element model is used to describe the operational principles of the balun of this example. Wider line sections are modeled as grounded capacitors. Narrower line sections are modeled as inductors. Ports are modeled as resistors. The transformations are shown in step 2 of FIG. 3(*c*). The lumped model after transformation is shown in step 3 of FIG. 3(*c*). From the lumped model, element 55 is only a grounded inductor (the capacitor is shorted by the grounding node 99 shown in step 1 of FIG. 3(*c*)). The function of element 44 is to transfer R2 and jwL2 to match R1. The achievement of the match is governed by the following equation:

$$\frac{1}{R1} \approx \frac{1}{R2} * \frac{1}{\left(1+\frac{L1}{L2}\right)^2 + \left(\frac{wL1}{R2}\right)^2} + j\left(wC - \frac{w^3\left(\frac{1}{R2}\right)^2 L1L2 + w(L1+L2)}{w^2(L1+L2)^2 + w^4\left(\frac{1}{R2}\right)^2 L1^2L2^2}\right) = \frac{1}{R2} * M(w) + jI(w) \tag{1}$$

From equation (1), M(w) is always smaller than 1 (this means that the impedance transformation 03/31=R1/R2>1 can be achieved) and I(w) can be zero (this means the reactance contribution from element 55 can be canceled) by properly choosing C and L1. Using stepped impedance matching at transmission lines 44, the total length of the balun 30 can be dramatically reduced depending on the stepped impedance ratio. This can be explained by equation (1). If the values of C and L1 are fixed, the wider line (lower impedance line and represented as a grounded capacitor in FIG. 3(*c*) requires a shorter length to achieve the fixed value of C, and the narrower line (higher impedance line and represented as an inductor in FIG. 3(*c*) needs a shorter length to achieve the fixed value of L1. The phenomenon is somewhat similar to that of a stepped impedance resonator, although different in principle. The larger the stepped impedance ratio is, the smaller the balun can be. Under such arrangement, the size of the balun circuit of the present invention can be much smaller than the conventional Marchand-type balun.

Figure 4:
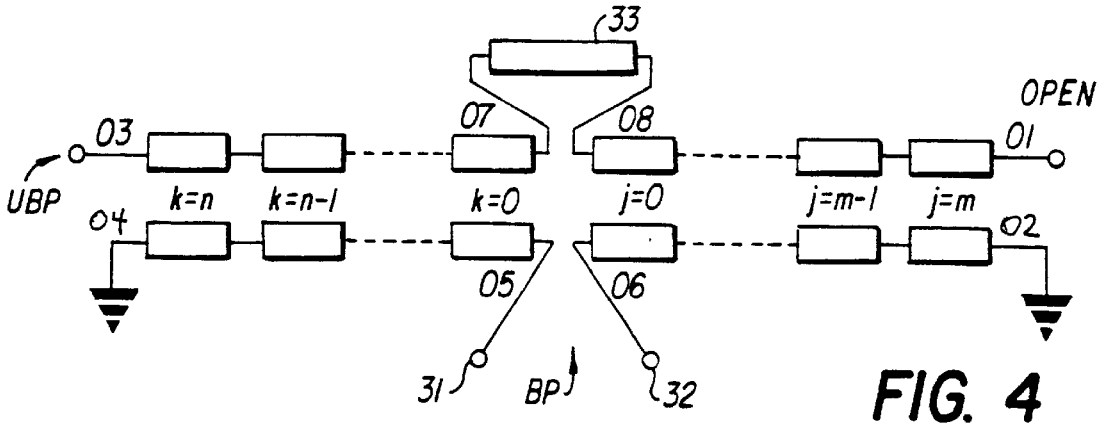
FIG. 4 illustrates a modification of the FIG. 3(*a*) embodiment.

When the impedance transformation ratio (03/31) is larger than 1, the line width of the top transmission line of the coupled-line section (shown in FIG. 3(*a*)) of larger numbering must be wider than that of smaller numbering to achieve the impedance matching. When the impedance transformation ratio (03/31) is smaller than 1, the line width of the upper transmission line of the coupled-line section of larger numbering must be narrower than that of smaller numbering to achieve the impedance matching. In some applications, since the circuit center is not an ideal electric wall, therefore, the amplitude balance of the miniaturized balun may degrade. An extra length of transmission line 33 shown in FIG. 4 connected to the upper ends 07,08 of the coupled line sections (k=0,l=0) can diminish the degradation.

Figure 5A:
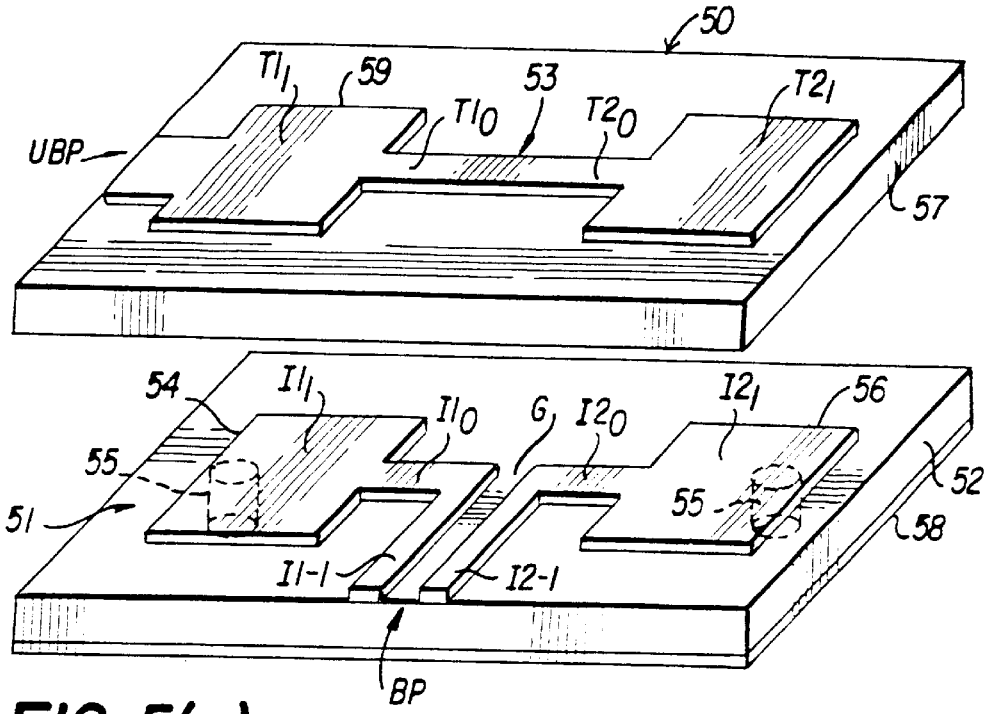
FIGS. 5(*a*)–8 show an implementation of the FIG. 3(*a*) embodiment in a multi-layer microstrip line structure.
Figure 5B:
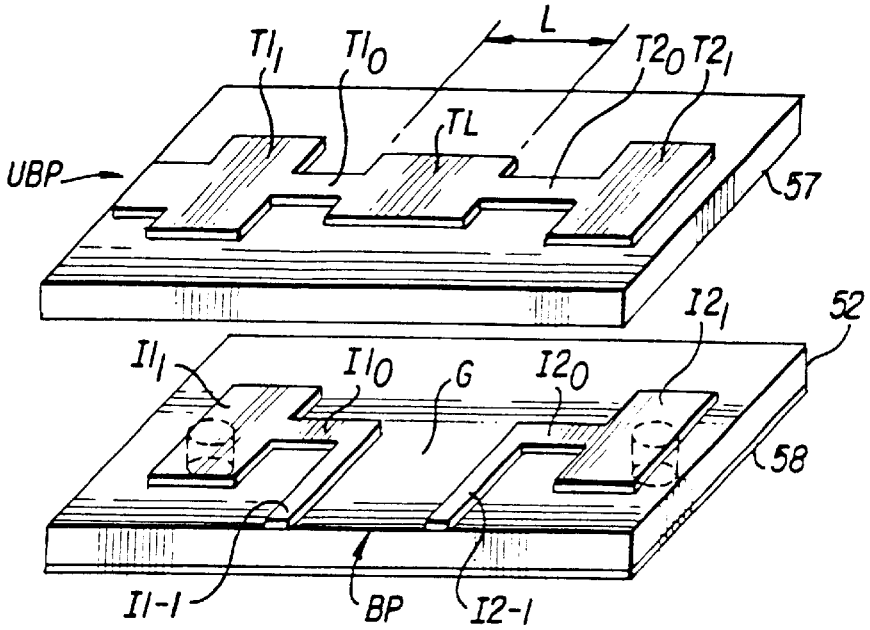
Figure 5C:
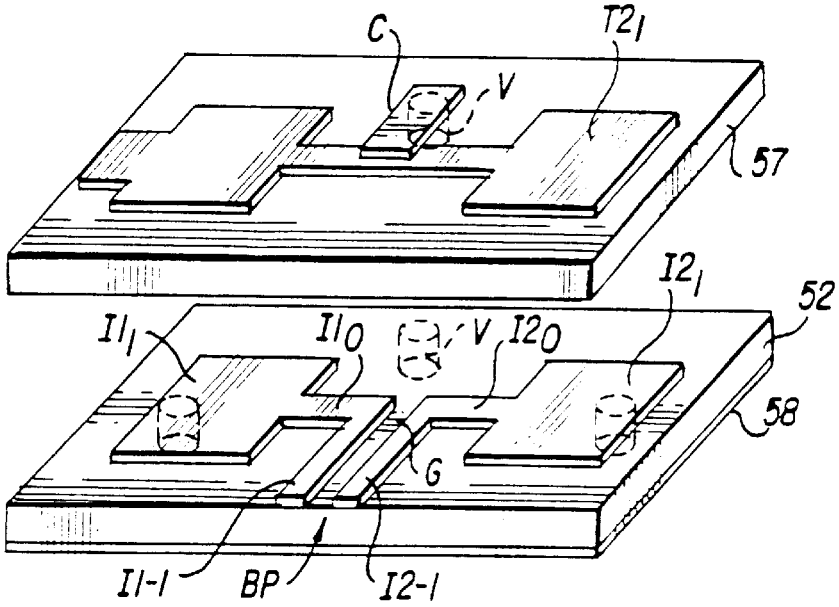

FIGS. 5(*a*)–14 show examples of the balun of the present invention where, k=j=2.

Figure 13:
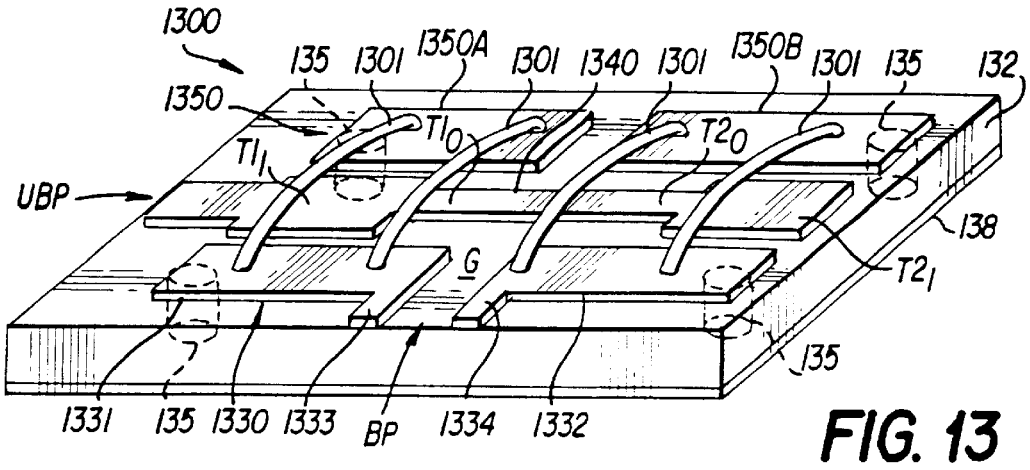
FIGS. 13–14 show an implementation of the FIG. 3(*a*) embodiment in which multi-lines are employed to achieve tighter coupling of the coupled-line sections.
Figure 14:
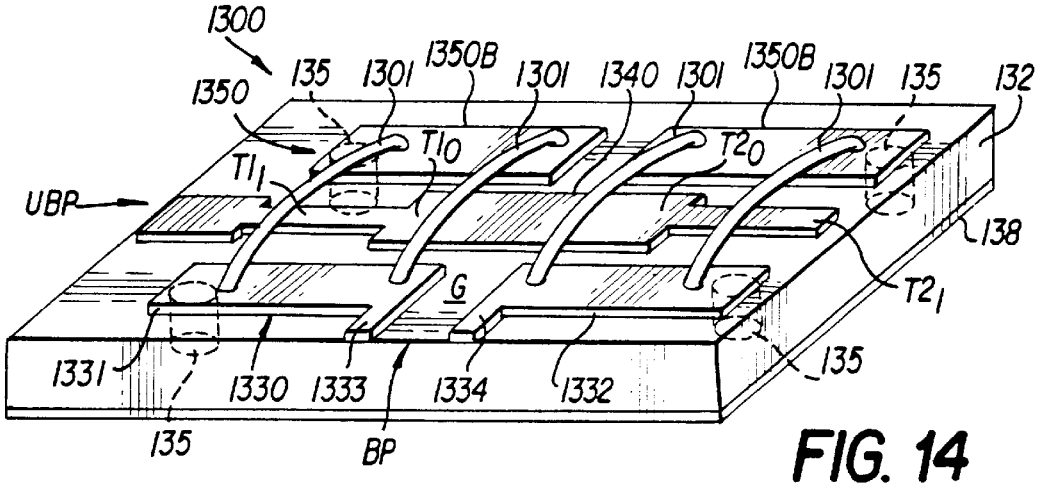

The inventive balun can be implemented in multi-layer microstrip line structure as shown in FIGS. 5(*a*)–8 and in multi-layer strip line structure as shown in FIGS. 9–12. Also it can be implemented in microstrip line structure with the coupled-line sections being placed at the same layer as shown in FIGS. 13–14. Those applications shown in FIGS. 13–14 use the multi-lines (the lower transmission lines in the coupled-line sections in FIG. 3(*a*)) to achieve tighter coupling of the coupled-line sections. If the coupling is not enough, the upper transmission lines in the coupled transmission line section in FIG. 3(*a*) can be composed of multi-lines. And the number of these multi-lines associated to the lower and upper transmission lines in FIG. 3(*a*) can be increased to achieve the desired coupling. The short circuit of the coupled-line sections is achieved by using via-holes to connect to the ground plane as shown in figures. Additionally, the coupled-lines sections of the inventive balun can be formed in spiral or zigzag shapes for further miniaturization (similar to those in reference [8]).

The balun circuits of FIGS. 5(*a*)–(*c*) achieve an impedance ratio (UBP/BP)≧1.

In FIG. 5(*a*), balun circuit 50 includes a dielectric substrate 52 having substantially planar opposing surfaces and a groundplane conductor layer 58 disposed on a first one of the opposing surfaces of substrate 52. An interlayer conductor layer 51 is disposed on a second one of the opposing surfaces of substrate 52. The interlayer conductor layer 51 comprises a first conducting strip 54 formed of a segment $I1_1$, a segment $I1_0$ and a strip I1-1 and a second conducting strip 56 formed of a segment $I2_0$, a segment $I2_1$, and a strip I2-1 as shown. First and second conducting strips 54 and 56 are electrically isolated from each other and have a balance point gap G therebetween. A load may be coupled across the balance point gap G via microstrip transmission line strips I1-1 and I2-1. Strips I1-1 and I2-1 thus provide balanced port terminals BP on respective sides of the balance point gap G. An interlayer dielectric layer 57 includes substantially planar opposing surfaces, a first one of which is disposed over the interlayer conductor layer 51. A top conductor layer 53 is disposed over a second one of the opposing surfaces of interlayer dielectric layer 57 and includes a third conducting strip 59 overlying the first and second conducting strips 54, 56, with one optional end of the third conducting strip 59 providing an unbalanced port terminal UBP. The third conducting strip 59 comprises a first set of series-connected line sections $T1_1$ and $T1_0$ having diverse impedances and a second set of series-connected line sections $T2_0$ and $T2_1$ having diverse impedances which are mirror opposites of the impedances of line sections $T1_1$ and $T1_0$ relative to a center plane of balun circuit 50 passing through balance point gap G and being orthogonal to the opposing surfaces of dielectric substrate 52 and 57. Also, regarding interlayer conductor layer 51, the first conducting strip 54 has an impedance which is a mirror opposite of an impedance of the second conducting strip 56 relative to the center plane. Phase and amplitude balance at the balance point gap G is achieved by the mirror opposite relationship of the impedances of the first set of line sections $T1_1$ and $T1_0$ and the second set of line sections $T2_1$ and $T2_0$ and the mirror opposite relationship of the impedances of the first and second conducting strips 54 and 56.

As shown in FIG. 5(*a*), the first set of line sections comprises a first segment $T1_0$ and a second segment $T1_1$ connected to one another and having different widths to provide a stepped impedance junction. First segment $T1_0$ is closer to the center plane and narrower than second segment $T1_1$. The second set of line sections comprises a third segment $T2_0$ and a fourth segment $T2_1$ connected to one another and having different widths to provide a stepped impedance junction, with third segment $T2_0$ being closer to the center plane and narrower than fourth segment $T2_1$. Also, segments $T1_0$ and $T2_0$ are connected to one another as shown.

First conducting strip 54 comprises a third set of series-connected line sections having diverse impedances, and second conducting strip 56 comprises a fourth set of series-connected line sections having diverse impedances which are mirror opposites of the diverse impedances of the third set of series-connected line sections relative to the center plane of circuit 50. The third set of line sections comprises a fifth segment $I1_0$ and a sixth segment $I1_1$ connected to one another and having different widths to provide a stepped impedance junction, with fifth segment $I1_0$ being closer to the center plane and being narrower than sixth segment $I1_1$. The fourth set of line sections comprises a seventh segment $I2_0$ and an eighth segment $I2_1$ connected to one another and having different widths to provide a stepped impedance junction, with seventh segment $I2_0$ being closer to the center plane and narrower than eighth segment $I2_1$. Impedance characteristics of the segments providing the stepped impedance junctions are set to achieve impedance matching of the unbalanced port UBP and the balanced port BP.

Figure 15:
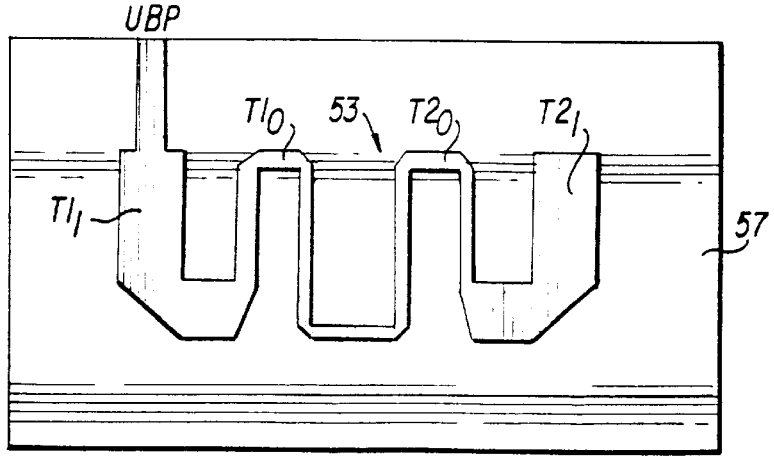
FIG. 15 is a top view of the top conductor layer of FIG. 5(*a*) in a meandered configuration.

FIG. 15 shows a top view of top conductor layer 53 of FIG. 5(*a*) in a meandered configuration. FIG. 16 is a top view of top conductor layer 53 of FIG. 5(*a*) in a spiral configuration. In FIG. 16, strip 501 is a conductor strip at another layer different from the surface of dielectric layer 57. The end of line section $T1_1$ is connected to strip 501 through a via 502. The end of strip 501 constitutes the UBP. Each of the other embodiments can employ meandered or spiral configurations as shown in FIGS. 15 and 16.

FIG. 5(*b*) shows a modified configuration of the balun of FIG. 5(*a*). FIG. 5(*b*) is similar to FIG. 5(*a*) except that a transmission line TL having length L connects the upper ends of the coupled segments $T1_0$ and $T2_0$. Transmission line TL functions to minimize the degradation of the amplitude balance of the balanced port BP.

FIG. 5(*c*) shows another modified configuration of the balun of FIG. 5(*a*). FIG. 5(*c*) adds a chip capacitor C having one end connected to the circuit center at the junction between segments $T1_0$ and $T2_0$ and its other end connected to groundplane conductor 58 for example through a via hole V in substrates 57 and 52. Chip capacitor C serves to reduce the degradation of the amplitude balance of balanced port BP.

Figure 6:
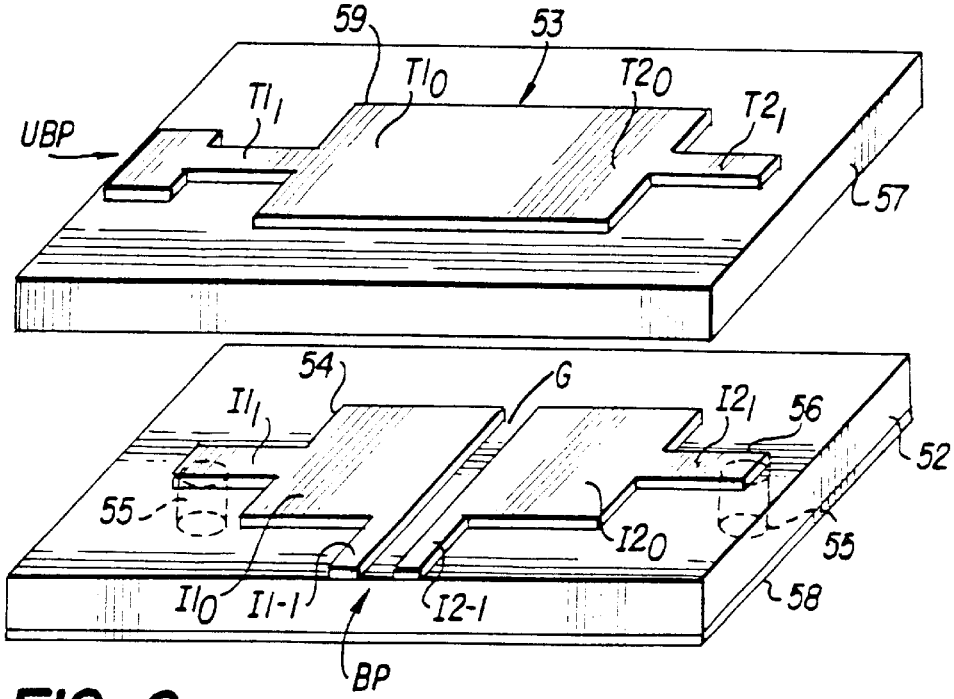

FIG. 6 is similar to FIG. 5(*a*) except that first segment $T1_0$ is wider than second segment $T1_1$, third segment $T2_0$ is wider than fourth segment $T2_1$, fifth segment $I1_0$ is wider than sixth segment $I1_1$, and seventh segment $I2_0$ is wider than eighth segment $I2_1$. The balun circuit of FIG. 6 achieves an impedance ratio (UBP/BP)<1.

Figure 7:
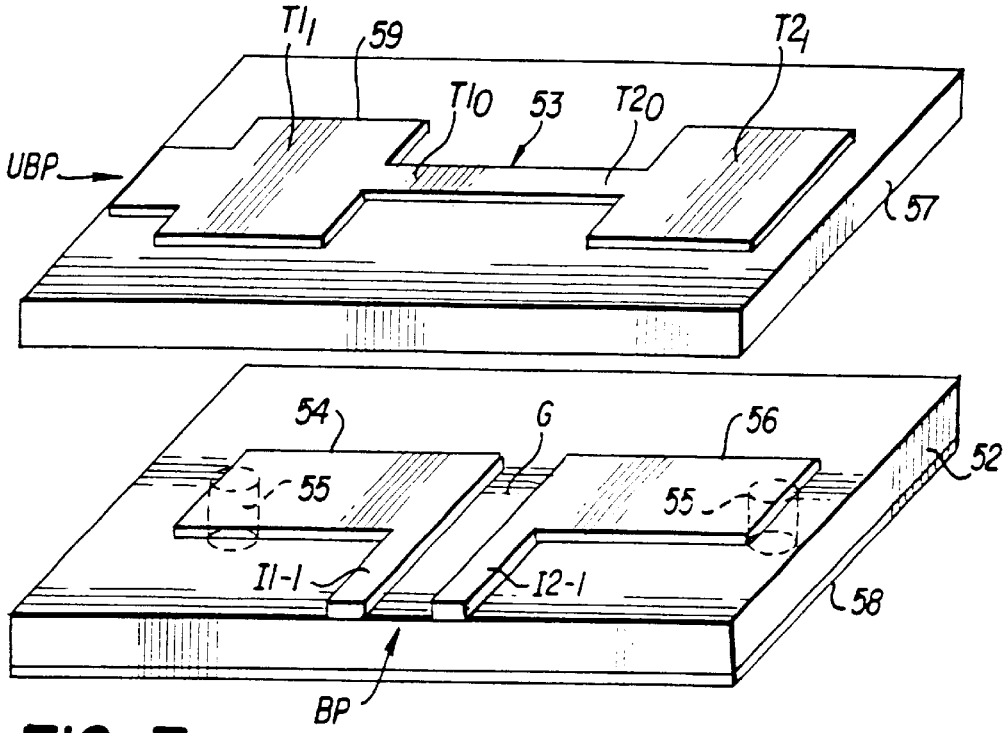
Figure 8:
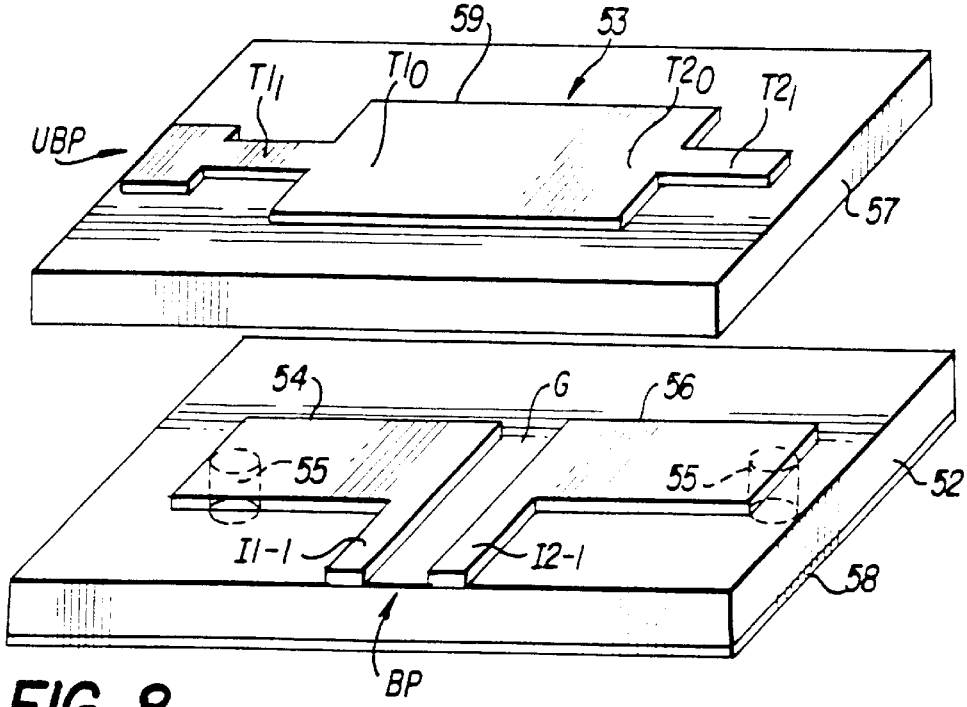
Figure 9:
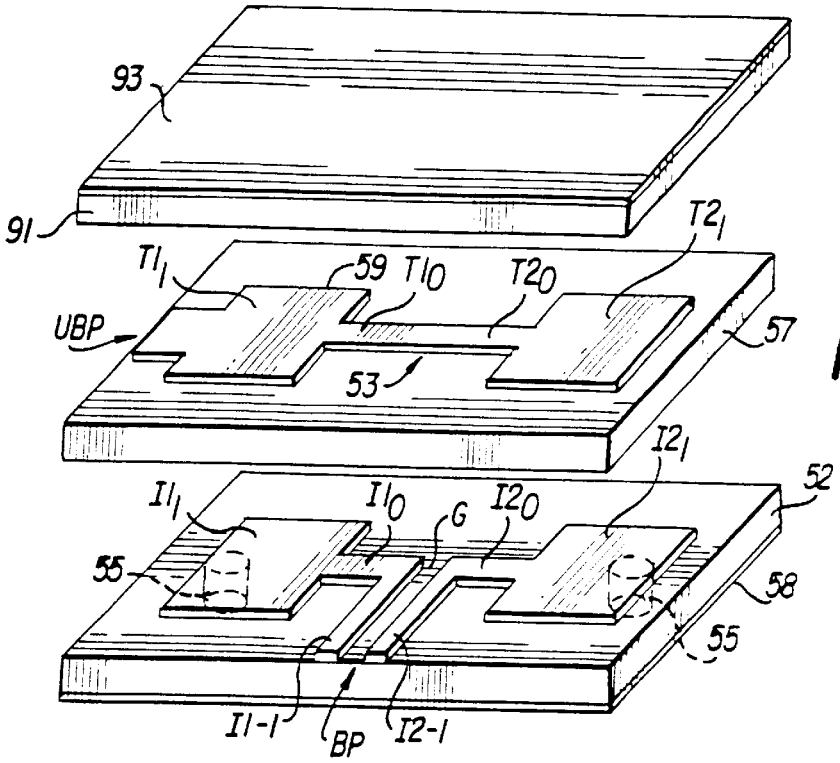
FIGS. 9–12 show an implementation of the FIG. 3(*a*) embodiment in a multi-layer strip line structure.
Figure 10:
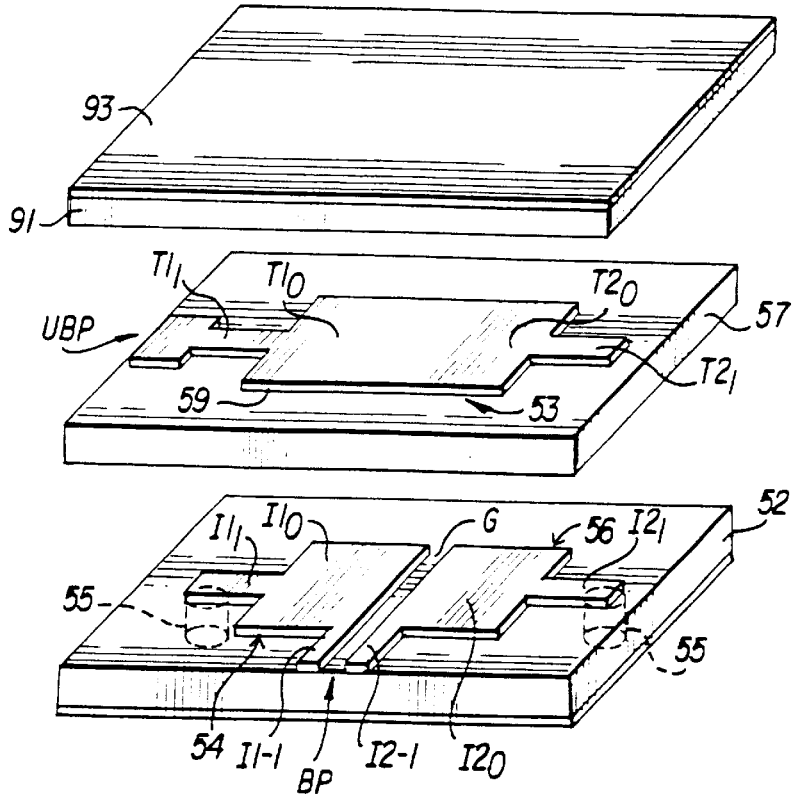
Figure 11:
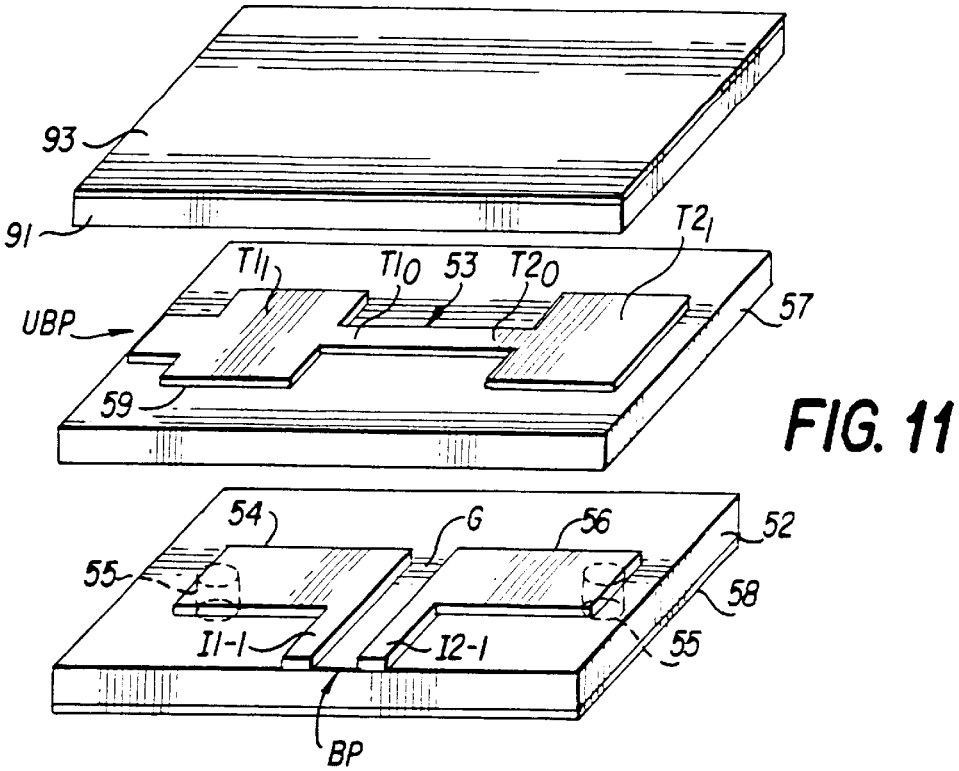
Figure 12:
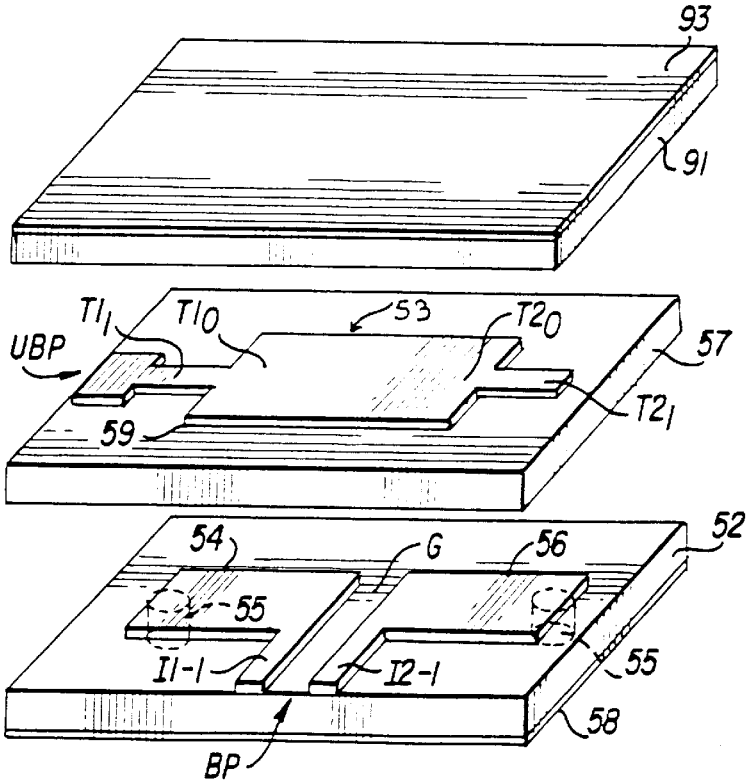

FIGS. 7 and 8 are similar to FIGS. 5(*a*) and 6 respectively except that the first conducting strip 54 and the second conducting strip 56 of the interlayer conductor layer have substantially uniform widths and hence they have non-diverse impedances and do not form a stepped impedance junction.

FIGS. 9–12 are similar to FIGS. 5(*a*)–8 respectively except that of each FIGS. 9–12 is a stripline configuration which includes a second dielectric layer 91 having substantially planar opposing surfaces with a first one of its opposing surfaces disposed over top conductor layer 53 and a second groundplane conductor layer 93 disposed on a second one of the opposing surfaces of second dielectric layer 91.

FIG. 13 shows a balun circuit 1300 which comprises a dielectric substrate 132 having substantially planar opposing surfaces and a groundplane conductor layer 138 disposed on a first one of the opposing surfaces of dielectric substrate 132. A first conductor layer 1330 is disposed on a second one of the opposing surfaces of dielectric substrate 132 and comprises first and second conducting strips 1331 and 1332 electrically isolated from each other and having a balance point gap G therebetween. A load may be coupled across the balance point gap via microstrip transmission line strips 1333 and 1334. Strips 1333 and 1334 thus provide balanced port terminals BP on respective sides of the balance point gap G. A second conductor layer 1340 is disposed on the second one of the opposing surfaces of dielectric layer 132 and comprises a third conducting strip spaced apart from and substantially parallel to first and second conducting strips 1331 and 1332. One optional end of the second conducting strip provides an unbalanced port terminal UBP. A third conductor layer 1350, including a conducting strip formed of two separate sections 1350A and 1350B as shown, is disposed on the second one of the opposing surfaces of dielectric layer 132 and is spaced apart from and substantially parallel to the first, second and third conducting strips. A plurality of bond wires 1301 interconnect the separate sections of third conductor layer 1350 with first and second conducting strips 1331 and 1332 as shown. The third conducting strip of second conductor layer 1340 comprises a first set of series-connected line sections $T1_1$ and $T1_0$ having diverse impedances and a second set of series-connected line sections $T2_0$ and $T2_1$ having diverse impedances which are mirror opposites of the impedances of line sections $T1_1$ and $T1_0$ relative to a center plane of balun circuit 1300 passing through the balance point gap G and being orthogonal to the opposing surfaces of dielectric substrate 132. The first conducting strip 1331 has an impedance which is a mirror opposite of an impedance of the second conducting strip 1332 relative to the center plane of circuit 1300. Phase and amplitude balance at the balance point gap G is achieved by the mirror opposite relationship of the impedances of the first and second set of line sections of the third conducting strip of second conducting layer 1340 and the mirror opposite relationship of the impedances of the first and second conducting strips 1331 and 1332. The first set of line sections comprises a first segment $T1_0$ and a second segment $T1_1$ connected to one another and having different widths to provide a stepped impedance junction, with first segment $T1_0$ being closer to the center plane and being narrower than second segment $T1_1$. The second set of line sections comprises a third segment $T2_0$ and a fourth segment $T2_1$ connected to one another and having different widths to provide a stepped impedance junction, with third segment $T2_0$ being closer to the center plane and being narrower than fourth segment $T2_1$.

In FIG. 13, the first and second conducting strips 1331 and 1332 are shown with non-diverse impedances. Alternatively, first conducting strip 1331 can comprise a third set of series-connected line sections having diverse impedances, and second conducting strip 1332 can comprises a fourth set of series-connected line sections having diverse impedances which are a mirror opposite of the diverse impedances of the third set of series-connected line sections relative to the center plane of circuit 1300. The third set of line sections can comprise a fifth segment and a sixth segment connected to one another and having different widths to provide a stepped impedance junction, with the fifth segment being closer to the center plane and being narrower than the sixth segment, and the fourth set of line sections can comprise a seventh segment and an eighth segment connected to one another and having different widths to provide a stepped impedance junction, with the seventh segment being closer to the center plane and being narrower than the eighth segment. Alternatively, the fifth segment can be wider than the sixth segment and the seventh segment can be wider than the eighth segment. In such case, with regard to second conductor layer 1340, the first segment is wider than the second segment and the third segment is wider than the fourth segment, as shown in FIG. 14, which is similar to FIG. 13 except that first segment $T1_0$ is wider than second segment $T1_1$, and third segment $T2_0$ is wider than fourth segment $T2_1$.

Impedance characteristics of the segments providing the stepped impedance junctions can be set to achieve impedance matching of the unbalanced port UBP and the balanced port BP.

In FIGS. 5(*a*), 7, 9, 11 and 13, the impedance ratio (UBP/BP) is 1. In FIGS. 6, 8, 10, 12 and 14, the impedance ratio (UBP/BP) is <1.

Although the present invention has been fully described by way of examples with reference to the accompanying drawings, it should be understood that numerous variations, modifications and substitutions, as well as rearrangements and combinations, of the preceding embodiments will be apparent to those skilled in the art without departing from the novel spirit and scope of this invention.

What is claimed is:

1. A balun circuit comprising:

(a) a dielectric substrate having substantially planar opposing surfaces;

(b) a groundplane conductor layer disposed on a first one of said opposing surfaces;

(c) a first conductor layer disposed on a second one of said opposing surfaces and comprising first and second conducting strips electrically isolated from each other and having a balance point gap between first ends thereof, wherein balanced port terminals are provided on respective sides of said balance point gap, said first and second strips having second ends that are short-circuited to said groundplane conductor layer;

(d) a second conductor layer disposed on said second one of said opposing surfaces and comprising a third conducting strip spaced apart from and substantially parallel to said first and second conducting strips, one end of said third conducting strip providing an unbalanced port terminal and another end of said third conducting strip being open-circuited;

(e) a third conductor layer disposed on said second one of said opposing surfaces and comprising a fourth conducting strip comprising first and second sections having a gap therebetween and each being spaced apart from and substantially parallel to said first, second and third conducting strips, said first and second sections of said fourth conducting strip each being connected to said groundplane conductor layer; and (f) a plurality of bond wires interconnecting said first section of said third conductor layer with said first conducting strip and a plurality of bond wires interconnecting said second section of said third conductor layer with said second conducting strip, wherein:

said third conducting strip comprises a first set of series-connected line sections having diverse impedances and a second set of series-connected line sections having diverse impedances which are a mirror opposite of said diverse impedances of said first set of line sections relative to a center plane of said balun circuit passing through said balance point gap and being orthogonal to said opposing surfaces of said dielectric substrate, and said first conducting strip has an impedance which is a mirror opposite of an impedance of said second conducting strip relative to said center plane, whereby phase and amplitude balance at said balance point gap is achieved by said mirror opposite relationship of said impedances of said first and second set of line sections and said mirror opposite relationship of said impedances of said first and second conducting strips.

2. A balun circuit according to claim 1, wherein said first set of line sections having diverse impedances comprises a first segment and a second segment connected to one another and having different widths to provide a stepped impedance junction, said first segment being closer to said center plane and being wider than said second segment, and said second set of line sections having diverse impedances comprises a third segment and a fourth segment connected to one another and having different widths to provide a stepped impedance junction, said third segment being closer to said center plane and being wider than said fourth segment.

3. A balun circuit according to claim 1, wherein said first set of line sections having diverse impedances comprises a first segment and a second segment connected to one another and having different widths to provide a stepped impedance junction, said first segment being closer to said center plane and being narrower than said second segment, and said second set of line sections having diverse impedances comprises a third segment and a fourth segment connected to one another and having different widths to provide a stepped impedance junction, said third segment being closer to said center plane and being narrower than said fourth segment.

4. A balun circuit according to claim 3, wherein:

said first conducting strip comprises a third set of series-connected line sections having diverse impedances, said second conducting strip comprises a fourth set of series-connected line sections having diverse impedances which are mirror opposites of said diverse impedances of said third set of series-connected line sections relative to said center plane, and said third set of line sections having diverse impedances comprises a fifth segment and a sixth segment connected to one another and having different widths to provide a stepped impedance junction, said fifth segment being closer to said center plane and being narrower than said sixth segment, and said fourth set of line sections having diverse impedances comprises a seventh segment and an eighth segment connected to one another and having different widths to provide a stepped impedance junction, said seventh segment being closer to said center plane and being narrower than said eighth segment, whereby impedance characteristics of said segments providing said stepped impedance junctions are set to achieve impedance matching of said unbalanced port and said balanced port.

5. A balun circuit according to claim 3, wherein:

said first conducting strip comprises a third set of series-connected line sections having diverse impedances, said second conducting strip comprises a fourth set of series-connected line sections having diverse impedances which are mirror opposites of said diverse impedances of said third set of series-connected line sections relative to said center plane, and said third set of line sections having diverse impedances comprises a fifth segment and a sixth segment connected to one another and having different widths to provide a stepped impedance junction, said fifth segment being closer to said center plane and being wider than said sixth segment, and said fourth set of line sections having diverse impedances comprises a seventh segment and an eighth segment connected to one another and having different widths to provide a stepped impedance junction, said seventh segment being closer to said center plane and being wider than said eighth segment, whereby impedance characteristics of said segments providing said stepped impedance junctions are set to achieve impedance matching of said unbalanced port and said balanced port.

6. A balun circuit according to claim 1, wherein said second conductor layer further comprises a fifth conducting strip interconnecting said first set of line sections and said second set of line sections, said fifth conducting strip minimizing degradation of said amplitude balance at said balance point gap.

7. A balun circuit according to claim 1, further comprising a chip capacitor having one end connected to said third conducting strip at said center plane and another end connected to said third conducting strip at said center plane and another end connected to said groundplane conductor layer.

8. A balun circuit according to claim 1, wherein said first, second and third conducting strips have one of a straight configuration, a spiral configuration and a zigzag configuration.

* * * * *